United States Patent [19]

Kagawa

[11] 4,403,946

[45] Sep. 13, 1983

[54] IGNITER UTILIZING PIEZO-ELECTRIC ELEMENT

[76] Inventor: Seiji Kagawa, No. 27-1-126, 3-Chome, Baba, Tsurumi-ku, Yokohama-shi, Kanagawa-ken, Japan

[21] Appl. No.: 309,426

[22] Filed: Oct. 7, 1981

[30] Foreign Application Priority Data

Oct. 23, 1980 [JP] Japan ..... 55/147638
Oct. 25, 1980 [JP] Japan ..... 55/149960
Jun. 16, 1981 [JP] Japan ..... 56/92782

[51] Int. Cl.[3] ..... F23Q 3/00

[52] U.S. Cl. ..... 431/255; 431/72; 431/89; 431/254

[58] Field of Search ..... 431/254, 255, 89

[56] References Cited

U.S. PATENT DOCUMENTS 3,802,828 4/1974 Mercer et al. ..... 431/255
3,909,186 9/1975 Kidwell et al. ..... 431/254
3,984,738 10/1976 Mohr ..... 431/255

FOREIGN PATENT DOCUMENTS 2156216 5/1973 Fed. Rep. of Germany ..... 431/255
717514 10/1954 United Kingdom ..... 431/254

*Primary Examiner*—Samuel Scott
*Assistant Examiner*—Allen J. Flanigan
*Attorney, Agent, or Firm*—Koda and Androlia

[57] ABSTRACT

Disclosed in this invention is an igniter making use of a piezo-electric element, comprising a stator, a movable piezo-electric unit, and a conductor provided coaxially in a cylindrical body as an assembly. The movable piezo-electric unit incorporates a piezo-electric element, and is arranged to be movable under the pressure of a gas flowing in a gas passage in the cylindrical body to impinge against the conductor to initiate spark discharge between the discharging electrodes connected to the respective electrodes of the piezo-electric element. A magnetic attractive force is produced between the stator and the movable piezo-electric unit to boost the impact force of the movable piezo-electric unit against the conductor.

8 Claims, 20 Drawing Figures

IGNITER UTILIZING PIEZO-ELECTRIC ELEMENT

BACKGROUND OF THE INVENTION

This invention relates to an igniter which makes use of a piezo-electric element, and more particularly to a device for igniting gasoline or other combustible gas by inducing spark discharge of a high voltage generated by giving an impact force to a piezo-electric element by a gas pressure. More specifically, the invention pertains to a device which is best suited as an ignition means adapted in a nozzle assembly of a gas burner used for cutting or welding of metals.

Piezo-electric ignition means for igniting a gas, etc., by means of spark discharge of a high voltage generated by giving a pressure to a piezo-electric element are known, and such ignition means are widely used for a variety of devices such as gas baths, gas heaters, gas lighters for cigarettes, etc.

The hitherto known piezo-electric ignition means were mostly of the type in which the energy accumulated on a spring is given to a piezo-electric element by an impact mechanism, and there has not yet been a piezo-electric ignition system where the pressure of a gas is converted into an impact force and such impact force is given to a piezo-electric element.

Generally, when lighting a gas burner used for cutting or welding of metal, one has to first turn on the gas and then ignite the spurting gas with a lighter, match, or other means. Thus, according to such igniting means, the operator is obliged to perform the troublesome works such as bringing the lighter or other lighting means close to the burner tip and then igniting the gas, and further he must be careful about the danger of explosion and resulting bodily injuries as there is possibility that the gas be exploded should the burner be lighted in a situation where the air around the burner is impregnant with the gas released from the gas burner due to failing to ignite because of wet match or ill-timing of lighting of the spurting gas, or for other causes. There are also involved other troubles such as looking for a lighter or other lighting means. In view of these circumstances, this inventor has made extensive studies for solving these problems and finally succeeded in achieving the present invention.

SUMMARY OF THE INVENTION

An object of this invention is to provide an igniter making use of a piezo-electric element, said igniter being best adaptable as an ignition means for gas burners used for cutting or welding of metals.

Another object of the invention is to provide an igniter characterized in that a magnetic attraction is produced between a stator and a movable piezo-electric unit so as to elevate the impact force by gas pressure of the movable piezo-electric unit against a conductor and the produced high voltage is discharged to emit sparks.

Still another object of the invention is to provide an igniter utilizing a piezo-electric element, said igniter being provided with a movable piezo-electric unit having a piezo-electric element integrally incorporated therein.

The igniter according to this invention comprises a cylindrical body having a gas passage therein, a movable piezo-electric unit arranged movable axially in the cylindrical body by the pressure of a gas flowing in said gas passage, a stator provided fixedly in said cylindrical body on its gas pressure side, said stator being designed to produce a magnetic attractive force between it and said movable piezo-electric unit and communicated with said gas passage through a through-hole formed therein, and a conductor also provided fixedly in said cylindrical body on the side remote from said stator, said conductor having a gas passage and designed such that said movable piezo-electric unit, when moved, will impinge thereagainst, said conductor being also electrically insulated from said cylindrical body by an insulator. A discharging electrode is electrically connected to said conductor while another discharging electrode is electrically connected to said cylindrical body in a spaced-apart relation from the first-said discharging electrode. Said movable piezo-electric unit has a piezo-electric element provided in a space in its body portion through the medium of an insulator, said piezo-electric element being held and fixed in position by a pressure receiving terminal adapted to receive the pressing force of the gas flowing in the gas passage in said cylindrical body and an impact terminal on the impact receiving face of said conductor.

The above-said and other objects and advantages of this invention will become more apparent as this description proceeds to describe the invention with reference to the accompanying drawings.

DETAILED DESCRIPTION OF THE INVENTION

Figure 1:
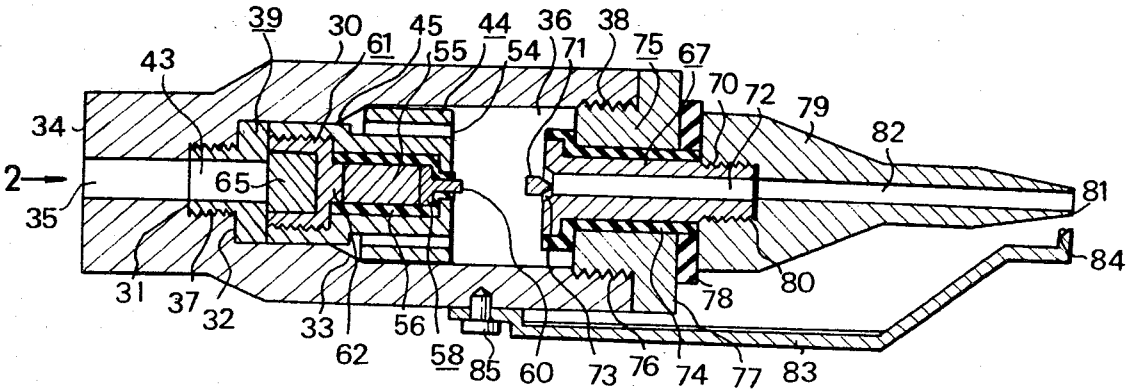
FIG. 1 is a longitudinal sectional view showing the whole structure of the device of this invention.
Figure 2:
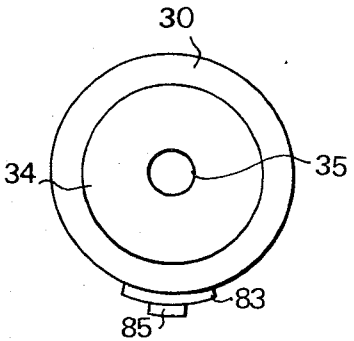
FIG. 2 is an end view taken in the direction of arrow 2 of FIG. 1.

Referring to FIGS. 1 and 2, there is shown an igniter embodying the present invention. The igniter has a cylindrical body 30 connected to a gas supply passage, said cylindrical body 30 being made of a metal such as brass and having a hollow extending axially therethrough, said hollow being formed with the forwardly facing stepped portions 31, 32 and a forwardly slanting portion 33 so that the inner diameter increases gradually toward the fore end. The hollow portion from the rear end face 34 to the first stepped portion 31 serves as a gas passage 35. The hollow portion from the second stepped portion 32 forwards in the cylindrical body 30 provides a space for housing a movable piezo-electric unit described in detail later.

The hollow portion between the first and second stepped portions 31 and 32 is provided with an internal thread 37, and also the opening front portion of the cylindrical body 30 is provided with an internal thread 38.

Figure 4:
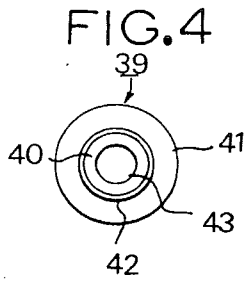
FIG. 4 is an end view taken in the direction of arrow 4 of FIG. 3.
Figure 3:
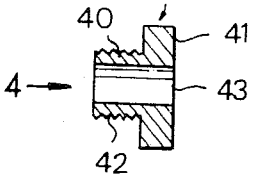
FIG. 3 is a longitudinal sectional view of a stator.

It will be also seen that a stator 39 is provided fixedly in the cylindrical body 30 on its gas passage side. This stator 39, as best shown in FIGS. 3 and 4, is formed from a magnetic material or a permanent magnet and has an integral flange 41 at the fore end of its annular portion 40. The outer diameter of said flange 41 is substantially equal to the inner diameter of the cylindrical body 30 at its portion between the second stepped portion 32 and the slant portion 33, and the annular portion 40 is provided on its entire external surface with an external thread 42 engageable with the internal thread 37 in the cylindrical body 30 and also as a through-hole 43 extending axially thereof. Thus, the stator 39 is fixed in position in the cylindrical body 30 by means of engagement of said internal and external threads 37 and 42, with the through-hole 43 being communicated with the gas passage 35.

Figure 6:
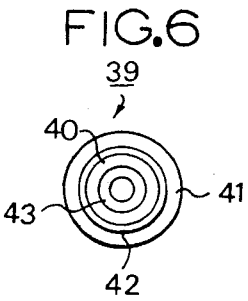
FIG. 6 is an end view taken in the direction of arrow 6 of FIG. 5.
Figure 5:
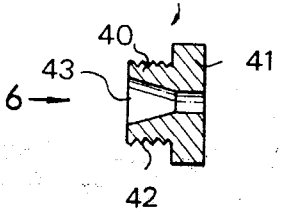
FIG. 5 is a longitudinal sectional view showing a modified form of stator.

The stator 39 may take other configurations, such as illustrated in FIGS. 5 and 6. In this embodiment, the through-hole 43 of the stator 39 is designed as an orifice which spreads out on the gass passage side of the cylindrical body 30. This design minimizes the flow resistance of the gas flowing in the gas passage 35 to enhance the impact force of the movable piezo-electric unit against the piezo-electric element as explained in detail later.

Figure 9:
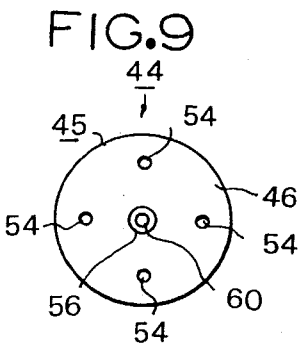
FIG. 9 is an end view taken in the direction of arrow 9 of FIG. 7.
Figure 8:
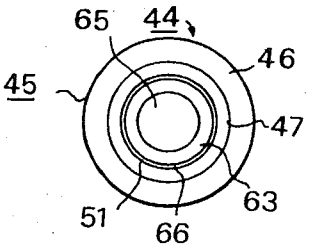
FIG. 8 is an end view taken in the direction of arrow 8 of FIG. 7.
Figure 7:
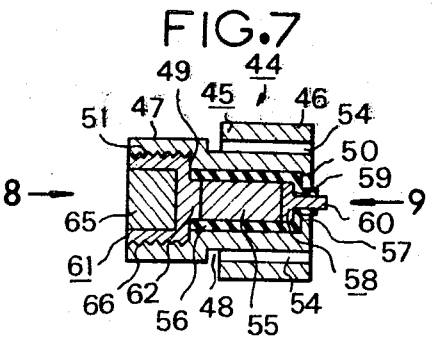
FIG. 7 is a longitudinal sectional view of a movable piezo-electric unit.
Figure 10:
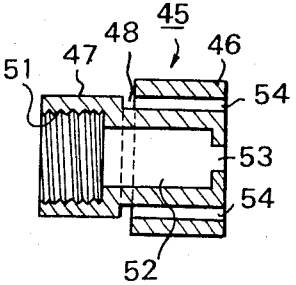
FIG. 10 is a longitudinal sectional view of the body portion of the movable piezo-electric unit.

In the hollow portion 36 of the cylindrical body 30 is provided a movable piezo-electric unit 44 which is movable in said hollow portion 36 axially of the cylindrical body 30 under the pressure of the gas flowing in the gas passage 35. This movable piezo-electric unit 44 is shown in FIGS. 7, 8 and 9; and as best seen from FIGS. 10 to 14, its metal-made body portion 45 having a circular cross section consists of a large-diameter portion 46 located forwardly along a substantially half length of the body portion 45 and a slightly smaller-diameter portion 47 located rearwardly of and integral with said large-diameter portion 46, with a recession 48 being formed at the boundary between said large-diameter and smaller-diameter portions 46 and 47. The outer diameter of the large-diameter portion 46 is substantially equal to the inner diameter of the hollow portion of the cylindrical body 30 forwards of the slant portion 33 while the outer diameter of the smaller-diameter portion 47 is substantially equal to the inner diameter of the hollow portion of the cylindrical body 30 between the second stepped portion 32 and the slant portion 33. In the body portion 45 of said piezo-electric unit 44, there are provided axially thereof, and defined by the rearwardly facing stepped portions 49 and 50 a high-pitch thread 51, a piezo-electric element housing space 52 and a small opening 53. Also, in the large-diameter portion 46, there are formed axially and in the outer peripheral edges thereof small gas passages 54 having a circular cross section and opening into the recession 48, said gas passages 54 being spaced apart from each other by 90° in terms of center angle. In the space 52 of the body portion 45 is provided a columnar piezo-electric element 55 through an insulator 56 such as ceramic, and the fore end of said insulator 56 has its stepped portion 57 engaged with the corresponding stepped end 50 of the body portion 45 to secure the insulator against loosening, said fore end reaching the opening 53.

On one electrode side of the piezo-electric element 55 is provided a metal-made impact terminal 58 which is electrically insulated from the body portion 45 by the insulator 56. This impact terminal 58, as best seen from FIGS. 13 and 14, has a flange 59 of the same diameter as the piezo-electric element 55 and a circular-cross-sectioned central protuberance 60 integral with said flange 59. The flange 59 is pressed against one end face of the piezo-electric element 55 and the protuberance 60 is provided fixedly such that it slightly projects from the opening 53 in the body portion 45.

Figure 11:
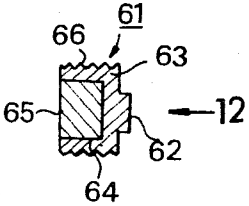
FIG. 11 is a longitudinal sectional view of the pressure receiving terminal of the movable piezo-electric unit.
Figure 12:
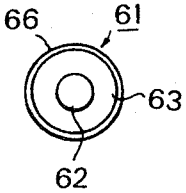
FIG. 12 is an end view taken in the direction of arrow 12 of FIG. 11.
Figure 13:
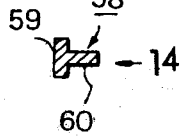
FIG. 13 is a longitudinal sectional view of the impact terminal of the movable piezo-electric unit.
Figure 14:
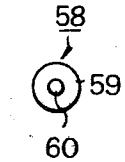
FIG. 14 is an end view taken in the direction of arrow 14 of FIG. 13.

A pressure receiving terminal 61 is provided on the other electrode side of the piezo-electric element 55; said pressure receiving terminal 61, as best seen from FIGS. 11 and 12, having a recession 64 in its body 63 having a circular-cross-sectioned protuberance 62 of the same diameter as the piezo-electric element 55, and a permanent magnet 65 is fitted and fixed in said recession 64 such that said magnet is flush with the end face of said recession 64. At this pressure receiving terminal 61 has its external thread 66 engaged with the corresponding internal thread 51 of the body portion 45, the protuberance 62 gives a compressive force to the piezo-electric element 55 to let it fix to the body portion 45 while held by said pressure receiving terminal 61 and impact terminal 58.

Securing of the pressure receiving terminal 61 to the body portion 45 may be effected by caulking.

The permanent magnet 65 produces an attractive force between the movable piezo-electric unit 44 and the stator 39 to keep the pressure of the gas flowing from the gas passage 35 of the cylindrical body 30 into the through-hole 43 of the stator 39, whereby the instantaneous impact against the movable piezo-electric unit 44 is increased to give a high impact force to the piezo-electric element 55.

Attractive force is produced between a permanent magnet and a magnetic body, so that in case the permanent magnet 65 is provided in the movable piezo-electric unit 44, the stator 39 is made of a magnetic material, and in case the stator 39 is formed from a permanent magnet, the pressure receiving terminal 61 of the movable piezo-electric unit 44 is made of a magnetic material.

Figure 15:
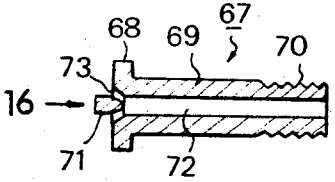
FIG. 15 is a longitudinal sectional view of a conductor.
Figure 16:
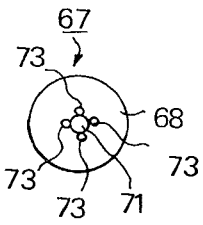
FIG. 16 is an end view taken in the direction of arrow 16 of FIG. 15.

In the cylindrical body 30, on its side opposite from the movable piezo-electric unit 44, is provided a conductor 67 arranged such that when the movable piezo-electric unit 44 is moved by the gas pressure, its impact terminal 58 will strike against said conductor 67. This conductor 67 is made of a metal such as brass, and as best seen from FIGS. 15 and 16, it has a flange 68 designed to receive the impact and a cylindrical body 69 integral therewith. Said cylindrical body 69 is formed with an external thread 70 at its rear end portion. At the central part of said flange 68 is provided an integral circular cross-sectioned protuberance 71 against which the impact terminal 58 of the movable piezo-electric unit 44 impinges. Also, at the base of said protuberance 71 joined to the flange 68 is formed small openings 73 in communication with a gas exhaust passage 72 formed in the cylindrical body 69 axially thereof, said small openings 73 being slant to provide a substantially 90° angular spacing from each other. The flange 68 and the cylindrical body 69 of said conductor 67 accepting the thread 70 are coated with an insulating material 74 such as Teflon, and the external thread 76 of a fixing nut 75 threadedly mounted on the coated portion 74 of the cylindrical body 69 from the thread 70 side is threadedly engaged with the corresponding internal thread 38 of the cylindrical body 30 to thereby fix the cylindrical body 30 in position in an electrically insulated relation. The fixing nut 75 has a flange of the same diameter as the cylindrical body 30 and abuts against the opposing end face of said cylindrical body 30.

An annular insulator 78 such as Teflon is provided at the part of the coating 74 projecting from the flange 77 of the fixing nut 75 of the conductor 67, and one of the discharging electrodes 79 is electrically connected to the conductor 67 through said insulator 78 as the internal thread 80 of said electrode 79 is engaged with the corresponding external thread 70 of the conductor 67. The fore end of the discharging electrode 79 terminates into a fine nozzle, and the foremost end 81 thereof constitutes a sparking point. In said electrode 79 is also formed axially thereof a gas passage 82 through which the gas in the cylindrical body 30 is discharged out.

The discharging electrode 79 may take various other configurations.

The other discharging electrode 83 mating with said electrode 79 is also electrically connected to the cylindrical body 30 as it is screwed, as at 85, to the external surface of the cylindrical body 30. The foremost end constituting the sparking point at the free end of said other electrode 83 is set with a predetermined spacing from the opposing sparking end 81 of the electrode 79.

The above-described preferred embodiment of this invention is now explained from its operational aspect.

Although not shown, the igniter assembly of this invention is properly set in a gas supply line through an integrally assembled cock or ball valve which can be opened and closed by a one-touch operation. As the igniter assembly is thus properly set, the gas pasage 35 in the cylindrical body 30 is communicated with the gas supply line.

In the state where the valve is closed and no gas is supplied from the gas supply line into the gas passage 35, the movable piezo-electric unit 44 is fastly attached to the stator 39 by the magnetic force of the permanent magnet 65 and hence the through-hole 43 in the stator 39 communicated with the gas passage 35 is closed tightly. This state is shown in FIG. 1.

Figure 17:
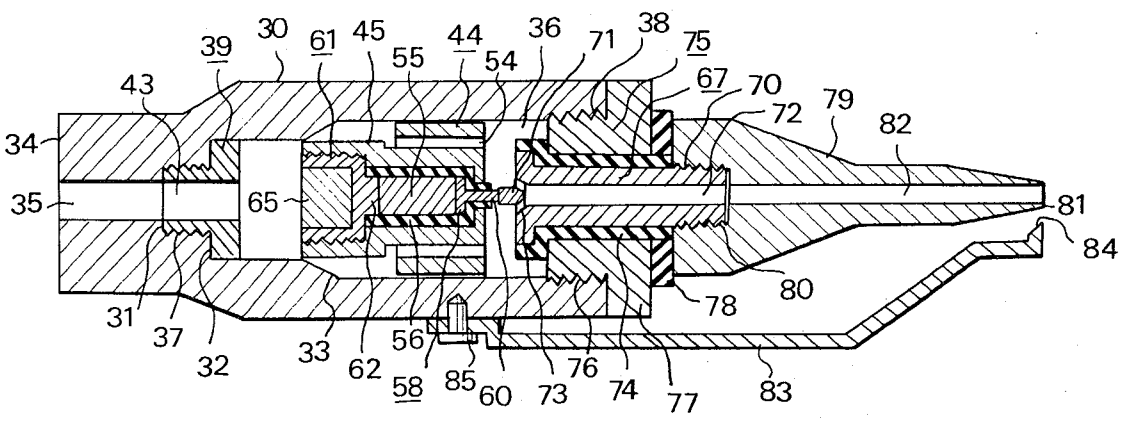
FIG. 17 is a longitudinal sectional view showing the operation of the device of this invention.

When the valve is opened to admit the gas from the gas supply line into the gas passage 35 and thence into the through-hole 43, the pressure is built up in the through-hole 43 and when the force due to the accumulated gas pressure exceeds the magnetic attractive force working between the stator 39 and the movable piezo-electric unit 44, said piezo-electric unit 44 is instantaneously moved forwards by the gas pressure to let the protuberance 60 at the impact terminal 58 of said unit 44 strike strongly against the corresponding protuberance 71 on the conductor 67. This state is shown in FIG. 17.

As the movable piezo-electric unit 44 moves, the gas in the cylindrical body 30 passes from the gas passage 54 in the piezo-electric unit 44 into the small openings 73 and gas passage 72 in the conductor 67 and released out through the gas passage 82 in the discharging electrode 79.

Upon impingement of the movable piezo-electric unit 44 against the conductor 67 under the gas pressure, an impact force is given to the piezo-electric element 55 to generate a high voltage, and a spark discharge occurs between the foremost end 81 of the discharging electrode 79 electrically connected to one of the electrodes of said piezo-electric element 55 via the impact terminal 58 and conductor 67 and the opposing foremost end 84 of the discharging electrode 83 electrically connected to the other electrode of said piezo-electric element 55 via the terminal 63, body portion 45, and cylindrical body 30, and the gasoline or other combustible gas is ignited by the sparks.

When the valve is again closed to shut off gas supply from the gas supply line, there no longer exists the gas pressure forcing the movable piezo-electric unit 44 forwardly, so that said unit 44 is again magnetically attracted to the stator 39 to restore the state shown in FIG. 1.

Thus, according to the ignition device of this invention, when the valve is opened to let in the gas in the gas supply line, the movable piezo-electric unit is forced to impinge strongly against the conductor by the gas pressure to impart an impact force to the piezo-electric element which is fixedly held and compressed between the pressure receiving terminal and the impact terminal, and further the instantaneous impact of the movable piezo-electric unit against the conductor is multiplied by the gas pressure pressing said piezo-electric unit forwardly, which has been sufficiently accumulated by the magnetic attractive force working between said piezo-electric unit and the stator and by the weight of said piezo-electric unit, so that a high voltage is produced in the piezo-electric element to infallibly induce spark discharge to effect desired ignition.

Figure 18:
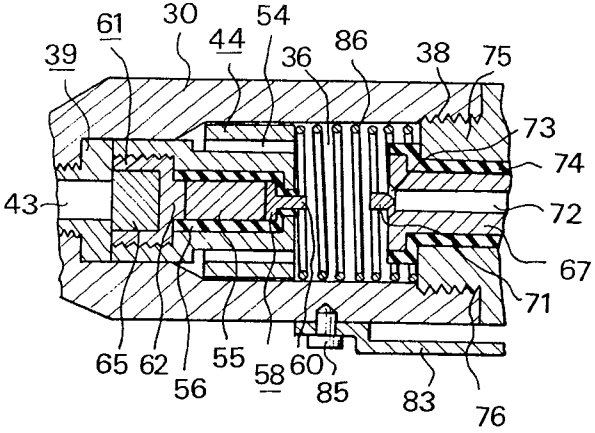
FIG. 18 is a longitudinal sectional view of the principal parts illustrating another embodiment of the present invention.

Another preferred embodiment of this invention is illustrated in FIG. 18. In this embodiment, a coil spring 86 is provided between the movable piezo-electric unit 44 and the conductor 67 in the cylindrical body 30.

According to this embodiment, since the movable piezo-electric unit 44 is normally pressed against the stator 39 by the coil spring 86, there can be more effectively accumulated the gas pressure for striking the movable piezo-electric unit 44 against the conductor 67. Also, when the gas supply is stopped, the piezo-electric unit 44 which has been moved by the gas pressure is forced back by the elastic force of the coil spring 86 to ensure fast attachment to the stator 39. Therefore, the coil spring 86 used in this embodiment is enough if it can press the movable piezo-electric unit 44 to position where the attractive force acts between said unit and the stator 39 when the gas supply was stopped.

As understood from the foregoing detailed description, the igniter according to this invention features an arrangement in which a movable piezo-electric unit having a piezo-electric element integrally incorporated therein is forced to strike against a conductor by the pressure of a gas flowing in a gas passage to produce a high voltage in the piezo-electric element, and spark discharge is induced from such high voltage to ignite the gas, so that if the device is adapted as ignition means in a gas burner used for fusing or welding metals, it provides a very useful automatic gas igniter, as ignition is effected automatically and with safety upon inflow of the gas into the burner with opening of a valve in the gas supply line.

Figure 19:
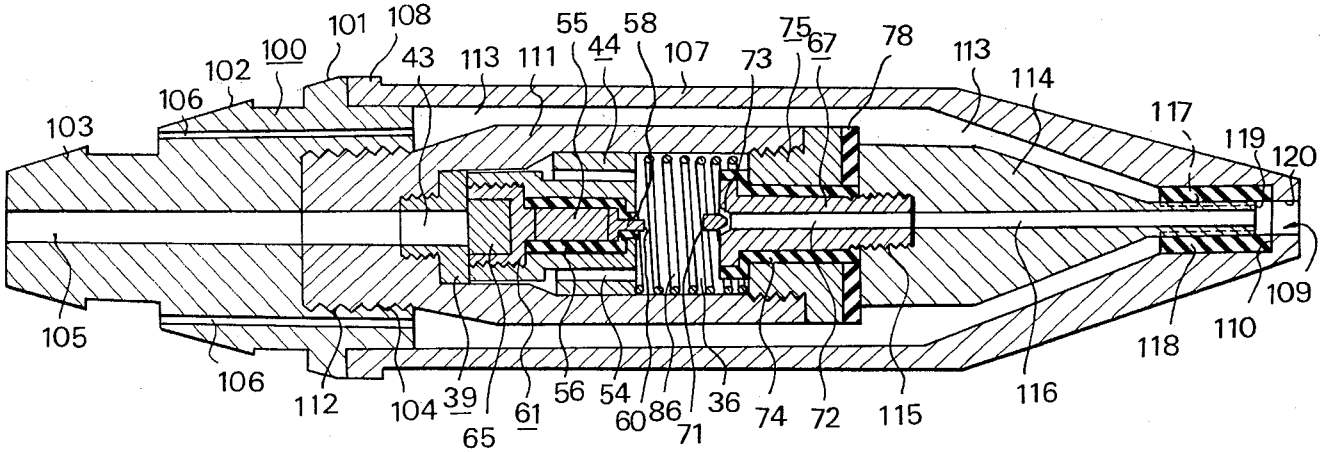
FIG. 19 is a longitudinal sectional view of a gas burner of a gas fusing machine adapted with the device of this invention.
Figure 20:
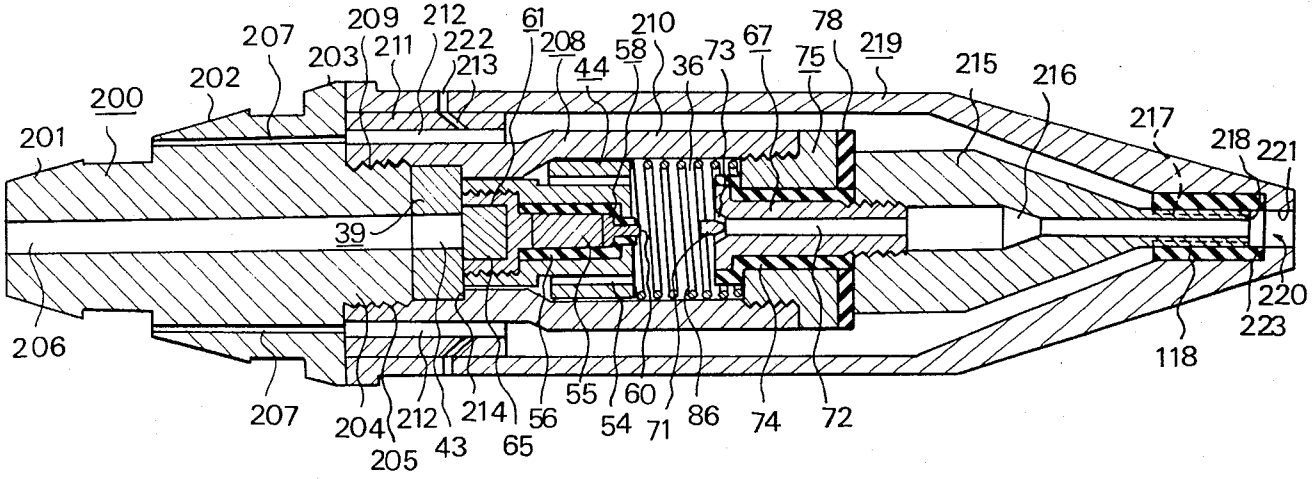
FIG. 20 is a longitudinal sectional view of a gas burner having a different structure of a gas fusing machine adapted with the device of this invention.

Some preferred burner structures adapted with the device of this invention are illustrated in FIGS. 19 and 20. It will be seen that, in these drawings, like reference numerals are used to indicate the like parts in the respective structures although such numbering is given only to the principal parts.

Referring to FIG. 19, the burner comprises a cylindrical body 100 which is to be fixed to a torch not shown and a cylindrical shell 107 joined securely to said cylindrical body 100 coaxially therewith. The cylindrical body 100 is made of a metal such as brass and has a flange 101 toward its fore end. Rearwardly of said flange 101 are provided two frusto-conical portions 102 and 103, and an internal thread 104 is provided on the inner peripheral surface of a cavity formed in the flanged end of the cylindrical body. Said cylindrical body 100 is also provided with a high-pressure oxygen inlet passage 105 extending centrally in the axial direction thereof and several mixed gas feed passages 106 extending forwardly from the rear end of the conical portion 102.

The cylindrical shell 107 is made of a metal such as brass and joined securely to the cylindrical body 100 as its open rear end formed with a flange 108 is fitted onto the fore end of the cylindrical body 100 until the flange 108 abuts against the corresponding flange 101 of the cylindrical body 100.

At the foremost end of the shell 107 is provided a gas jet 109 of a size smaller than the inner diameter of any other part, and a stepped portion 110 is formed in the inside thereof.

An inner cylinder 111 is threadedly joined to the cylindrical body 100 as the external thread 112 on said inner cylinder 111 is engaged with the corresponding internal thread 104 in the cylindrical body 100, and the space defined between the external surface of said inner cylinder 111 and the opposing internal surface of the outer cylinder or shell 107 provides a mixed gas passage 113.

The inner cylinder 111 is substantially identical with the cylindrical body 30 which forms a structural part of the device of this invention, and the gas passage 35 thereof is in communication with the pressurized oxygen inlet passage 105. In the inner cylinder 111 are provided a stator 39, a movable piezo-electric unit 44, a coil spring 86, and an electrically insulated conductor 67.

The conductor 67 is joined to an oxygen injection nozzle 114 as the externally threaded portion 70 thereof is screwed into the corresponding internally threaded portion 115 formed in a recession at the rear end of said oxygen injection nozzle 114. Said oxygen injection nozzle 114 is made of a metal such as brass. The central hole of said nozzle 114 is communicated with the gas passage 72 in the conductor 67, and its foremost end is positioned slightly inwardly of the gas jet 109 of the shell 107. A plurality of slits 117 are provided in the outer periphery of the foremost end portion of the nozzle 114 in the axial direction thereof. Between the fore end portion of the oxygen injection nozzle 114 and the shell 107 is interposed an insulator 118, such as ceramic, with its fore end face abutting against the stepped portion 110 of the shell 107, said insulator 118 being so positioned that the slits 117 in the fore end portion of the nozzle 114 are kept in communication with the mixed gas passage 113 defined between the external surface of the nozzle 114 and the opposing internal surface of the shell 107. A perfect electrical insulation is established between the shell 107 and the oxygen injection nozzle 114 by said insulator 118.

The oxygen injection nozzle 114 is also electrically insulated from the inner cylinder 118 by an insulator 78 and is merely connected to the conductor 67 alone to form an electrical connection with one of the electrodes of the piezo-electric element 55, so that said nozzle 114 has the same function as the discharging electrode 79 and its foremost end 119 serves as a sparking point. Also, since the shell 107 is electrically connected to the other electrode of the piezo-electric element 55, it has the same function as the discharging electrode 83 and the inner peripheral surface 120 of its gas jet 109 acts as a sparking point.

The burner incorporated with the device of this invention is adapted to a torch by fixing the cylindrical body 100 side thereto. When they are duly assembled, the pressurized oxygen inlet passage 105 is communicated with the corresponding pressurized oxygen outlet in the torch, and the mixed gas inlet passage 106 with the corresponding mixed gas outlet in the torch.

In the non-use state, the gas burner valve is kept closed to inhibit any gas supply; more specifically, the movable piezo-electric unit 44 stays attached to the stator 39 to tightly close the through-hole 43 of the stator 39 as shown in FIG. 19. In use of the gas burner, the valve is opened to first admit in the mixed gas. The mixed gas flows through the mixed gas inlet passage 106 and passage 113 and further passes through the slits 117 in the oxygen injection nozzle 114 to spurt from the gas jet 109 in the shell 107. Then pressurized oxygen is supplied. This pressurized oxygen passes through the pressurized oxygen inlet passage 105 and gas passage 35 in the inner cylinder 111 into the through-hole 43 in the stator 39. Oxygen pressure is accumulated until it comes to exceed the combined force of the magnetic attraction working between the stator 39 and the movable piezo-electric unit 44, and the pressing force of the coil spring 86, and when the force due to the accumulated oxygen pressure exceeds said combined force, the movable piezo-electric unit 44 impacts against the conductor 67. Pressurized oxygen at the same time passes through the gas passage 54 in the piezo-electric unit 44, small openings 73 in the conductor 67, gas passage 72, and then central hole 116 of the oxygen injection nozzle 114 to spurt out from the gas jet 109 of the shell 107.

Concurrently with spurt of pressurized oxygen, a high voltage is produced in the piezo-electric element 55 by impingement of the movable piezo-electric unit 44 against the conductor 67, and a spark discharge occurs between the foremost end 119 (spark point) of the oxygen injection nozzle 114, which is electrically connected to one of the electrodes of said piezo-electric element 55 via impact terminal 58 and conductor 67, and the opposing inner peripheral face 120 of the gas jet of the shell 107, which is electrically connected to the other electrode of the piezo-electric element 55 via pressure receiving terminal 61, body 45, and inner cylinder 111, and the mixed gas spurted from the slits 117 in the nozzle 114 is ignited by the sparks. Thereafter, the movable piezo-electric unit 44 stays at its foremost position in the space 36 under the pressure of successively supplied pressurized oxygen. When the valve is closed, the oxygen pressure forcing the movable piezo-electric unit 44 forward is eliminated, so that the piezo-electric unit 44 is again attracted to the stator 39 by the combined force of the coil spring 86 and magnetic attraction working between said unit 44 and the stator 39, to restore it to the original state.

Thus, the burner adapted with the device of this invention is capable of effecting automatic, secure, quick and very safe ignition upon supply of a gas to the burner, without requiring any troublesome work for ignition.

FIG. 20 illustrates another burner assemblage embodying the present invention.

In the illustration, as readily noted, only the parts different in structure from those in the burner of FIG. 19 are assigned the reference numerals commencing with 200 while the like parts are assigned the like numerals and not given detailed explanation to avoid redundancy.

The cylindrical body 200 to be joined to the torch is made of a metal such as brass and has the frusto-conical portions 201, 202, and 203 arranged in that order from the rear to fore end. It also has an integral cylindrical portion 204 positioned forwardly of the conical portion 203, and formed with an external thread 205. Extending centrally through the cylindrical body 200 is a pressurized oxygen inlet passage 206. Also, several mixed gas feed passages 207 are provided, extending horizontally from the fore end face of the conical portion 202 to the rear end face of the conical portion 203.

The cylindrical body 200 is joined coaxially to a cylinder 208 as the external thread 205 of the cylindrical body 200 is screwed onto the corresponding internal thread 209 in the inner cylinder 208. The inner cylinder 208 corresponds to the cylindrical body 30, which is a structural part of the device of this invention; and it is made of a metal such as brass, and consists of a small-diameter fore portion 210 and a large-diameter rear portion 211, the former portion 210 being slightly longer than the latter 211. In the large-diameter portion 211, several mixed gas passages 212 are provided, extending from the rear end face to the fore end face in communication with the respective mixed gas inlet passages 207 in the cylindrical body 200. Also, in the outer periphery of said large-diameter portion 211 is provided a slant outer air suction hole 213 communication with the mixed gas passage 212. Further, in the large-diameter portion 211 of the inner cylinder 208 is provided a stator 39, which is held and fixed in position by the end face of the cylindrical portion 204 of the cylindrical body 200, and a stepped portion 214 on the inner periphery of the large-diameter portion 211. In the small-diameter portion 210 are provided a movable piezo-electric unit 44, a coil spring 86, and an electrically insulated conductor 67, said conductor 67 being coaxially secured to an oxygen injection nozzle 215.

A pocket 216 is formed halfway in the injection hole of said oxygen injection nozzle 215. The oxygen pressure which has been partly reduced by pressing the movable piezo-electric unit 44 is restored to the original pressure (the oxygen pressure as initially supplied) to elevate the flow rate in the injection hole to provide a required jet flow.

A plurality of slits 217 are provided in the outer periphery of the fore end portion of the oxygen injection nozzle 215, and its foremost end 218 constitutes a sparking point.

The outer cylinder or shell 219 is integrally fixed to the large-diameter portion 211 of the inner cylinder 208 as the rear open end of said outer cylinder 219 is fitted onto said large-diameter portion 211 until it abuts against the fore end face of the conical portion 203 of the cylindrical body 200. The space defined between the inner surface of said outer shell 219 and the opposing outer surface of the inner cylinder 208 provides a mixed gas passage 113 communicated with said mixed gas passage 212.

The shell 219 is made of a metal such as brass, and at the foremost end thereof is provided a gas jet 220 which is smaller than the inner diameter of any other part, with the inner peripheral face 221 of said gas jet 220 constituting a sparking point. In the outer periphery of the rear portion of said shell 219 is provided an outer air suction hole 222 in communication with the suction hole 213 in the inner cylinder 208. Also, a stepped portion 223 is provided inside the foremost end of the shell 219, and an insulator 118 such as ceramic is interposed between the shell 219 and the fore end portion of the oxygen injection nozzle 215, with the end of said insulator 118 abutting against said stepped portion 223 as shown.

The burner of the above-described structure is secured to a torch not shown, and when the burner valve is opened, there ensue the same operations as in the case of the preceeding embodiment to induce spark discharge between the foremost end 218 of the oxygen injection nozzle 215 and the opposing inner peripheral face 221 of the gas jet of the shell 219, and the mixed gas is ignited by the sparkes emitted. When the valve is closed, the same operations as in the case of the already described embodiment are repeated.

In the case of this burner, oxygen in the outer air is introduced through the air suction hole 222 in the shell 219 and the similar air suction hole 213 in the inner cylinder 208 to enter the mixed gas passage 113, and is mixed with the gas therein to ensure positive ignition of the gas. Also, even when the pressure of pressurized oxygen is lessened as it is used for forcing the movable piezo-electric unit 44 to its moremost position, oxygen pressure is restored to its initial level by the pocket 216 in the oxygen injection nozzle 215 to provide a required jet flow.

What is claimed is:

1. An igniter utilizing a piezo-electric element, comprising a cylindrical body having a gas passage, a movable piezo-electric unit provided in the space in said cylindrical body so as to be movable axially of said cylindrical body by the pressure of a gas flowing in said gas passage, a stator adapted to produce a magnetic attraction between said stator and said movable piezo-electric unit, said stator being provided fixedly in said cylindrical body on its gas passage side and having a through-hole in communication with said gas passage, and a conductor disposed in said cylindrical body on its side opposite from said stator such that said movable piezo-electric unit will impinge thereagainst when said unit is moved, said conductor having a gas passage and fixed in its position while electrically insulated from said cylindrical body by an insulator, said conductor being also electrically connected to one of the discharging electrodes while the other discharging electrode is electrically connected to said cylindrical body in a spaced-apart relation with the first-said discharging electrode, said movable piezo-electric unit being provided with a piezo-electric element disposed in the space of said cylindrical body through an insulator, said piezo-electric element being held and fixed in position by a pressure-receiving terminal adapted to receive the pressing force of the gas flowing in the gas passage in said cylindrical body and an impact terminal provided at the impact receiving face of said conductor.

2. The igniter according to claim 1, wherein an elastic member is provided between the movable piezo-electric unit and the conductor in said cylindrical body, said elastic member being designed to press the movable piezo-electric unit toward said stator.

3. The igniter according to claim 2, wherein at least one of said stator and said pressure-receiving terminal of said movable piezo-electric unit is made of a magnetic material and the other is made of a permanent magnet.

4. The igniter according to any one of claims 1-3, wherein only one piezo-electric element is provided in said movable piezo-electric unit.

5. The igniter according to claim 4, wherein the foremost end of the impact terminal of said movable piezo-electric unit projects out from the end face of the cylindrical body.

6. The igniter according to claim 5, wherein said movable piezo-electric unit has gas passages formed in the outer periphery of its body portion in its axial direction.

7. The igniter according to any one of claims 1-3, wherein the through-hole of said stator is formed as an orifice spread out on its side opposing the gas passage in said cylindrical body.

8. The igniter according to any one of claims 1-3, wherein a protuberance is provided on the impact receiving face of said conductor, said protuberance being so designed that the impact terminal of said movable piezo-electric unit will impinge thereagainst.

* * * * *